United States Patent [19]

Fukase et al.

[11] 4,342,384

[45] Aug. 3, 1982

[54] MEDAL REMINANT SLOT MACHINE GAMES

[75] Inventors: Motonobu Fukase, Tanashi; Toshikazu Yokota; Masahisa Oura, both of Sayama, all of Japan

[73] Assignee: Sayama Precision Industrial Co., Ltd., Sayama, Japan

[21] Appl. No.: 148,049

[22] Filed: May 8, 1980

[30] Foreign Application Priority Data

May 17, 1979 [JP] Japan ..... 54-64923[U]

[51] Int. Cl.[3] ..... G07D 9/00

[52] U.S. Cl. ..... 194/1 C; 194/DIG. 11; 194/1 F; 133/1 R; 221/9; 221/17

[58] Field of Search ..... 194/1 R, 1 C, 1 F, DIG. 11; 133/1 R, 4 R; 221/9, 10, 17

[56] References Cited

U.S. PATENT DOCUMENTS 3,841,457 10/1974 Kawasaki et al. ..... 194/1 F X
3,860,017 1/1975 Black et al. ..... 133/1 R
4,036,242 7/1977 Breitenstein et al. ..... 133/4 R
4,157,139 6/1979 Björk ..... 133/1 R X

FOREIGN PATENT DOCUMENTS 52-12050 1/1977 Japan ..... 194/1 C

*Primary Examiner*—Joseph J. Rolla
*Attorney, Agent, or Firm*—Holman & Stern

[57] ABSTRACT

Coin ruminant slot machine games comprising a plurality of slot machines, back feeders, blockaders and a belt conveyer, the slot machines being respectively coupled with the back feeders, the back feeders being respectively coupled with the blockaders, the slot machines being located above the belt conveyer and the back feeders below the belt conveyer. The blockaders are located above a lower section of the conveyer belt and the slot machines discharge the coins to an upper section of the conveyer belt. The back feeders feed the coins back up to the slot machines and the belts of the conveyer, and the blockaders take the coins off of the lower belt to drop them into the back feeders.

6 Claims, 5 Drawing Figures

MEDAL REMINANT SLOT MACHINE GAMES

BACKGROUND OF THE INVENTION

1. Field of the Invention

The present invention is in International Class A63F and U.S. Class 273 Subclass 138R and relates to INDOOR GAMES and CHANCE DEVICES wherein the invention provides coin ruminant slot machine games comprising a plurality of slot machines, back feeders, blockaders, and a belt conveyer. The slot machines are coupled respectively with the back feeders, and the back feeders are coupled respectively with the blockaders. The slot machines are located above the belt conveyer, the back feeders are located below the belt conveyer, and the blockaders are located over a lower belt of the conveyer. The slot machines discharge the coins onto an upper belt of the conveyer, the back feeders feed the coins back up to the slot machines and the belts of the conveyer, and the blockaders move down on the lower belt to take the coins off of the belt into the back feeders.

2. Description of the Prior Art

Previous slot machine games have been controlled by charging the coins or tokens by hand so that many troubles have occurred in playland management as the number of games increase. The slot machine games according to this invention are under group control by a coin ruminant automatic system which overcomes the former defects.

BRIEF SUMMARY OF THE INVENTION

An object of the invention is to provide coin ruminant slot machine games wherein a plurality of slot machines, back feeders, blockaders and a belt conveyer are coupled together so that the slot machines discharge the coins onto an upper section of the belt conveyer, the back feeders feed the coins back up to the slot machines and the belts of the conveyer, and the blockaders move down on the lower section of the belt to take the coins off of the belt and direct them into the back feeders.

Another object of the invention is to provide coin ruminant slot machine games in which two back feeders are located under both ends of the belt conveyer, one of the back feeders receiving the coins which are naturally dropped from one of the ends and feeding the coins back up onto the lower section of the belt, the other back feeder receiving the coins which are dropped by a fixed blockader and feeding the coins back up onto the upper belt section.

The features of the invention provide automatic control of the coins through a plurality of slot machines to feed the coins back again to the respective slot machines where necessary.

The operation of the invention is controlled by electrical devices operatively associated to provide a coin circulation mechanism for a number of slot machines.

DESCRIPTION OF PREFERRED EMBODIMENTS

Figure 2:
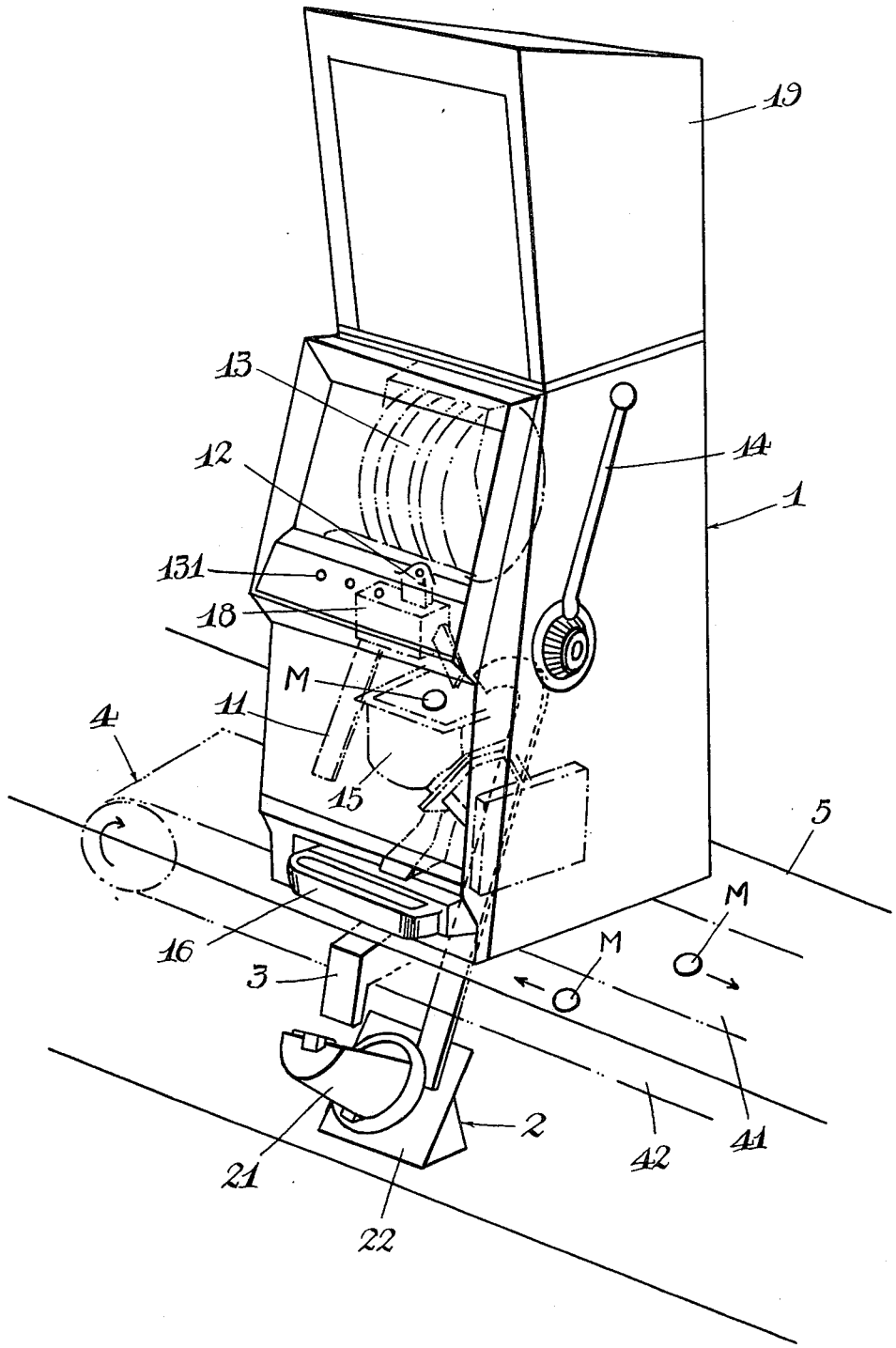
FIG. 2 is a front perspective view of the invention showing a part of the internal mechanism thereof.

Referring to the drawings it will be seen that the coin ruminant slot machine games of the invention which are illustrated therein include a number of machines 1, back feeders 2, blockaders 3 and a belt conveyer 4. The slot machines 1 are arranged in parallel on a long table 5 having an open space thereunder. The back feeders 2 are respectively coupled with the slot machines 1. The back feeders 2 are located below the conveyer 4. The conveyer 4 has both upper and lower belt sections 41, 42. The blockaders 3 are respectively coupled with the back feeders 2. The blockaders 3 are located above the lower belt section 42. The slot machine 1 has a channel 11 to discharge the coins M onto the upper belt section 41. The slot machine 1 has a slot 12, rotary reels 13, a handle 14, an inner hopper 15, a receipt plate 16, a selector 17, a channel changer 18 and an electromagnetic controller 19 as illustrated in FIG. 2.

The hopper 15 has level switches 151, 152 therein. The reels 13 are electrically connected with switch buttons 131. The channel changer 18 may guide the coins M into the hopper 15 or the channel 11.

The back feeder 2 has an outer hopper 21 and a lifter 22. The hopper 21 also has level switches 211, 212. The switches 151, 152 and 211, 212 can detect overload or shortage of the coins M in the hoppers 15 and 21. The switches 151, 152 are electrically connected with the lifters 22 and may stop or drive the lifters 22. The switches 211, 212 are also electrically connected with the blockaders 3. When there is a coin shortage in the hopper 21 the switch 212 will operate the blockader 3 to block off the coins M on the lower belt 42 into the back feeder 2 and when there is a coin overload in the hopper 21 the switch 211 will operate the blockader 3 to let the coins M pass over on the belt 42.

A back feeder 2 may be set under both ends of the conveyer 4, where one back feeder **2*a* has the lifter 22*a* which can lift up the coins M onto the lower belt 42 and the other back feeder 2*b* has the lifter 22*b* which can lift up the coins M onto the upper belt 41. The coins M will be directly dropped from one end into the hopper 21*a* of back feeder 2*a*. However the coins M are always dropped by a fixed blockader 3*b* at the other end into the hopper 21*b* of back feeder 2*b***.

Level switches **211*a*, 212*a* of the hopper 21*a* are electrically connected with the conveyer and may stop or drive the conveyer 4**.

Figure 1:
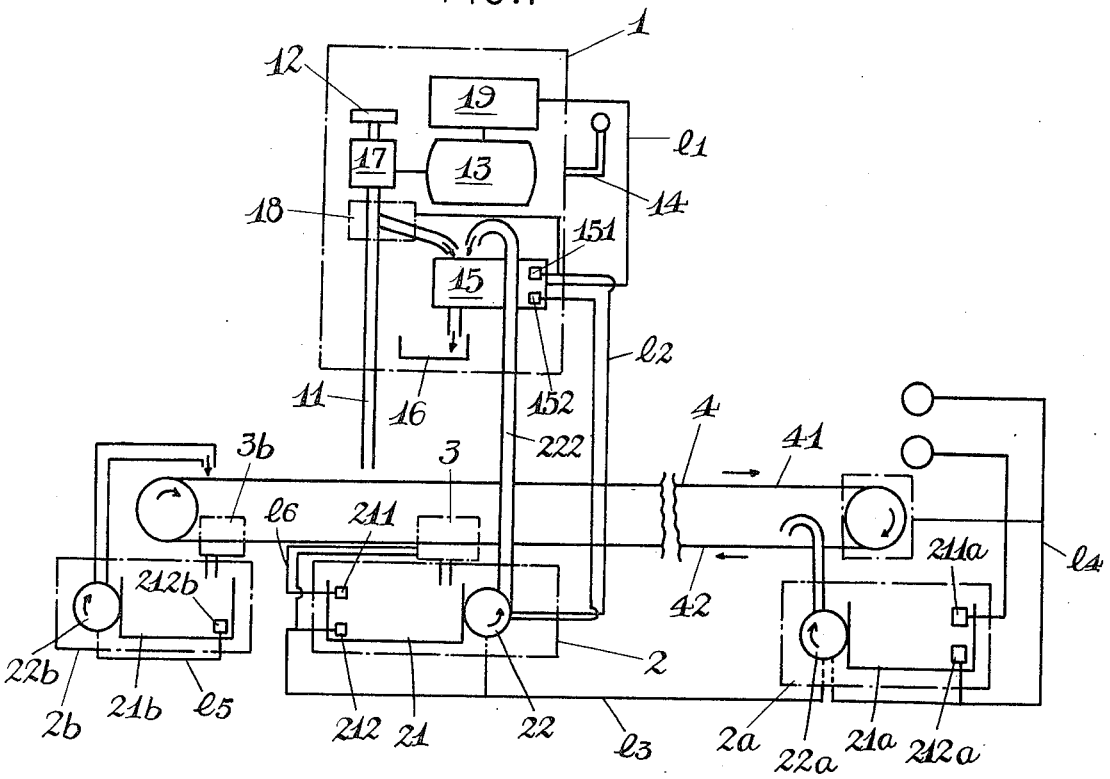
FIG. 1 is a schematic diagram of the medal ruminant slot machine games of the invention.

Electrical block diagrams are shown with lines $1_1$, $1_2$, $1_3$, $1_4$, and $1_5$ as shown in FIG. 1.

Figure 3:
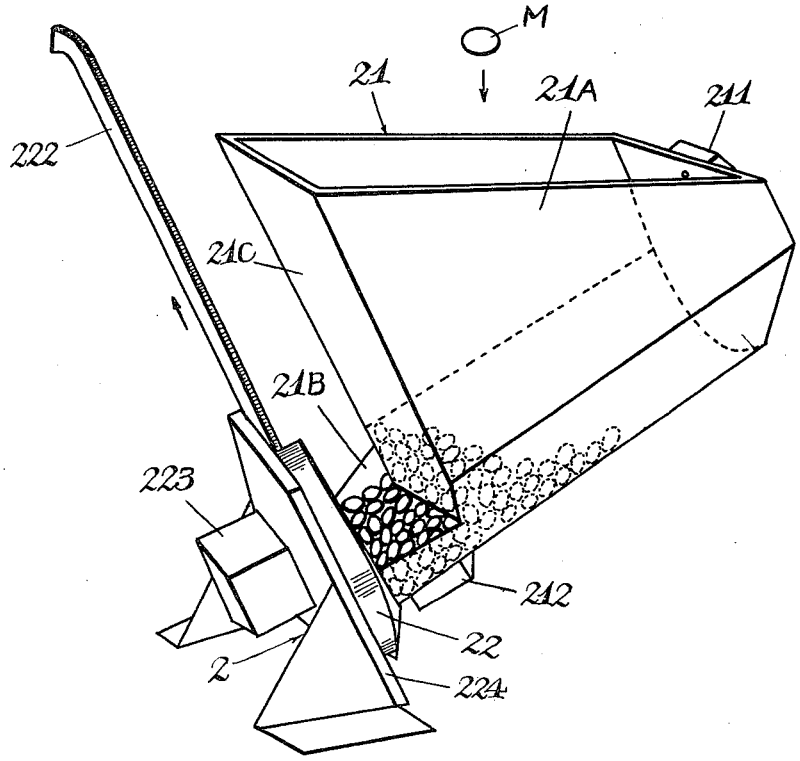
FIG. 3 is a perspective view of a back feeder as utilized in this invention.

The back feeder 2 comprises the hopper 21 and the lifter 22 in combination therewith as illustrated in FIG. 3. The hopper 21 has a storage part 21A and a guide part 21B with a partition 21C between the parts 21A, 21B which communicate with each other at a lower part of the partition 21G. The level switches 211, 212 are mounted at the top and bottom of the respective parts 21A, 21B. The lifter 22 comprises a rotor wheel 221, an upward guide rail 222, a motor 223 and a base plate 224. The wheel 221 and guide rail 222 are mounted on the front of plate 224 and the motor 223 is mounted on the rear of plate 224. The wheel 221 is driven by the motor 223.

Figure 4:
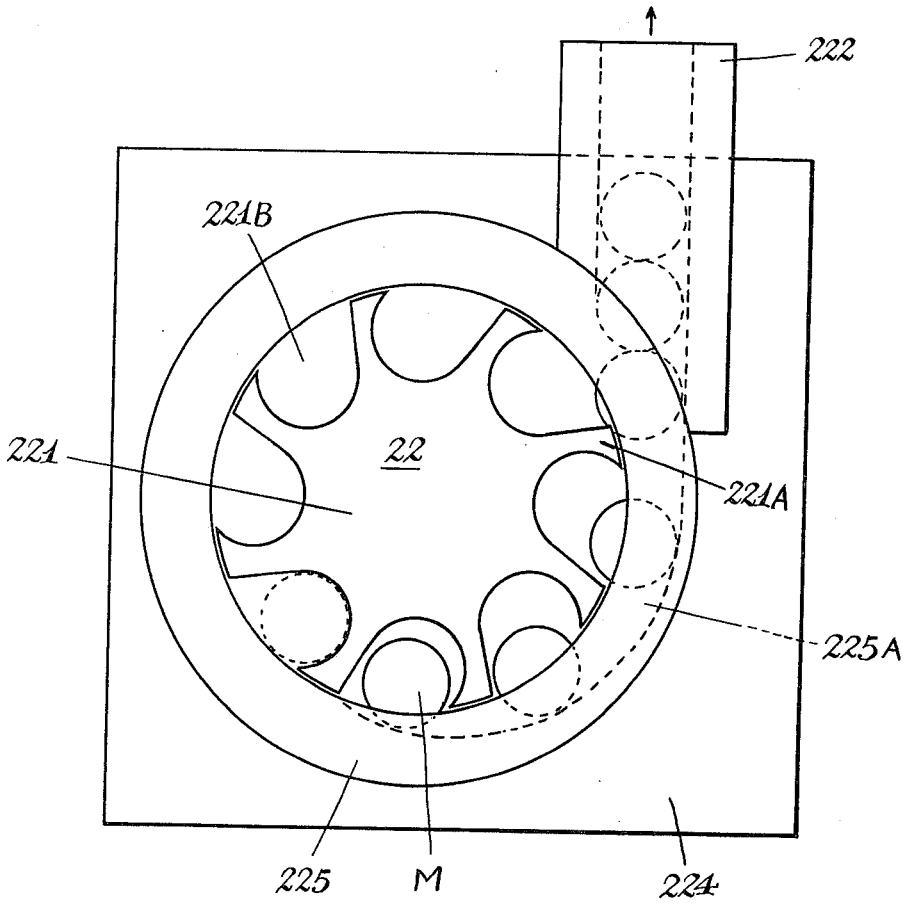
FIG. 4 is a partial front elevation view of a lifter of the back feeder of this invention.

Thus as may be seen from FIG. 4 the wheel 221 has circumferentially spaced radial arms 221A and a guide ring 225 is mounted around the wheel 221 on the plate 224.

The arms are shaped to provide vacant U-form sloped cavities 221B therebetween within the guide ring 225. The cavities 221B contain the coins M. The guide ring 225 has an inner guide way 225A which directs the coins to the guide rail 222.

The coins M are picked up by the wheel 221, which lifts them up one by one through the guide way 225A to feed them in a line into the guide rail 222.

Figure 5:
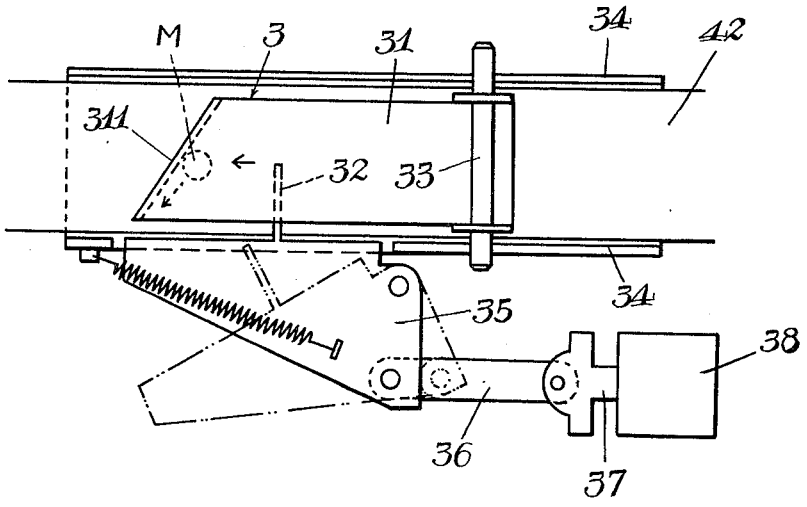
FIG. 5 is a top plan view of a blockader according to the invention.

The blockader 3, illustrated in FIG. 5, comprises a vertically pivotal plate 31 and a protruding piece 32. The plate 31 has a sloping end face 311. The piece 32 may enter and leave the space beneath the plate 31 above the belt 42. The plate 31 is pivoted on an axis 33 which is mounted over the belt 42 on a frame 34. The piece 32 projects from a level pivotal plate 35. The plate 35 is always urged with a spring toward the frame 34 about its pivotal axis. The plate 35 is pivotally connected to one end of a link member 36 which is pivotally connected at its other end to a plunger 37. The plunger 37 is the movable core of a solenoid 38. The solenoid 38 is electrically connected with the level switches 211, 212 of the hopper 21. When there is a coin shortage in the hopper 21 the solenoid 38 is energized to pull in the plunger 37 against the action of the spring and move members 35, 36 so that the piece 32 is retracted from under the plate 31. Then the plate 31 moves down on the belt 42 to block the coins M along the sloping end 311 to guide them so that they drop off the belt 42 into the hopper 21.

As many embodiments of the invention may be made without departing from the spirit and scope thereof, it is to be understood that the invention includes all such modifications and variations as come within the scope of the appended claims.

We claim:

1. Coin ruminant slot machine games comprising a combination of a plurality of slot machines, back feeders, blockaders and a belt conveyer, the slot machines being operatively coupled respectively with the back feeders, the back feeders being operatively coupled respectively with the blockaders, the slot machines being located above the belt conveyer, the back feeders being located below the belt conveyer, the blockaders being located adjacent the upper surface of the lower section of the belt conveyer, the aforesaid components being cooperatively arranged so that the slot machines discharge the coins onto the upper section of the belt conveyer, the back feeders feed the coins back up to the slot machines and upper and lower sections of the belt conveyer, and the blockaders move down onto the lower belt section to guide the coins off of the lower belt section into the back feeders, and means to operate the belt conveyer, back feeders and blockaders.

2. The combination of claim 1 and wherein one of said back feeders is located under each end of the belt conveyer, one of said back feeders receiving the coins which are naturally dropped off one end of the conveyer and feeding the coins back up onto the lower belt section, the back feeder at the other end receiving the coins which are dropped by a fixed blockader and feeding the medals back up onto the upper belt section.

3. The combination of claim 1 wherein each said back feeder has a lifter and a hopper, the lifter having a rotating wheel and a guide rail, the wheel having arms which pick up the coins from the hopper and feed them into the guide rail, the rail extending upwards to guide the coins in a line one by one therein, the hopper being adapted for receiving coins and feeding them to the wheel.

4. The combination of claim 3 wherein said hopper comprises two parts with a partition between them, one of said parts storing the coins and the other of said parts guiding the coins to said lifter, said parts communicating with each other under said partition.

5. The combination of claim 1 wherein said blockader comprises a vertically pivotal plate having a slanted end to block the coins moving forward on said lower belt section and to guide them off of the belt into said back feeder.

6. The combination of claim 5 and further comprising a protruding member on a movable element cooperatively associated with said vertically pivotal plate above said lower belt to move the vertically pivotal plate up and down with respect to the lower belt.

* * * * *